US005595260A

United States Patent [19]

Jalla

[11] Patent Number: 5,595,260

[45] Date of Patent: Jan. 21, 1997

[54] CONSTRUCTING AND ANALYZING REQUIREMENTS OF REUSABLE ROOFLINE ANCHOR

[76] Inventor: Maharaj K. Jalla, 7817 Calpurnia Ct., McLean, Va. 22102

[21] Appl. No.: 674,425

[22] Filed: Jul. 2, 1996

Related U.S. Application Data

[63] Continuation-in-part of Ser. No. 445,721, May 22, 1995, abandoned.

[51] Int. Cl.[6] ..... A62B 35/00

[52] U.S. Cl. ..... 182/3; 182/45; 52/DIG. 12; 52/749.12; 52/745.21; 52/713; 52/27; 248/316.7

[58] Field of Search ..... 52/27, 37, 749.12, 52/745.21, 713, DIG. 12; 182/3, 45; 248/57, 74.2, 200.1, 343, 316.7

[56] References Cited

U.S. PATENT DOCUMENTS

| | | | |
|---|---|---|---|
| 3,313,009 | 4/1967 | Beckerer | 248/74.2 |
| 4,356,986 | 11/1982 | Lynch | 248/57 |
| 5,044,582 | 9/1991 | Walters | 248/57 |
| 5,092,426 | 3/1992 | Rhodes | 182/3 |
| 5,148,890 | 9/1992 | Sipe | 182/45 |
| 5,346,036 | 9/1994 | Arisman et al. | 182/3 |
| 5,350,037 | 9/1994 | Ghahremani | 182/3 |
| 5,393,026 | 2/1995 | Deschamps et al. | 248/343 |
| 5,433,044 | 7/1995 | Walcher et al. | 52/DIG. 12 X |
| 5,435,574 | 7/1995 | Kerr | 248/343 |

*Primary Examiner*—Robert Canfield

[57] ABSTRACT

The present invention relates to a new method of construction of a reusable roofline anchor and its installation between two adjacent roof trusses of residential buildings in order to provide lifeline support to roofing personnel. The roofline anchor is separated into smaller and convenient components which can be easily assembled at the installation location. After installation, the load bearing member of the roofline anchor can be easily removed for reuse at a different location or for replacement subsequent to any damage.

4 Claims, 7 Drawing Sheets

CONSTRUCTING AND ANALYZING REQUIREMENTS OF REUSABLE ROOFLINE ANCHOR

RELATED APPLICATION

This application is a continuation-in-part of and co-owned U.S. patent application Ser. No. 08/445,721 filed on May 22, 1995 now abandoned, which is included herein by reference.

INTRODUCTION

The present invention relates to a new method of construction of a reusable roofline anchor and its installation between two adjacent roof trusses of residential buildings in order to provide lifeline support to roofing personnel.

Occupational Safety and Health Administration (OSHA) regulations require lifeline protection for roofing personnel working on inclined roofs. As required by the American National Standards Institute (ANSI), the roofline anchor must be capable of supporting a minimum dead-weight of 5400 pounds per worker.

The prior art has suggested various devices as fixed anchorages for lifelines. U.S. Pat. No. 5,346,036, issued to Arisman et al., presents a roof lifeline anchor device comprising of an elongated beam with U-shaped stirrups at each end as truss attachment structures. The device is fitted to truss assemblies from beneath and secured to the trusses by bolts passing through the stirrups and the truss beams. In this device, there is no definite arrangement available that enables removal of load bearing elongated beam for reuse at a different location.

The primary object of the present invention is to provide an alternative and a more practical method for constructing a roofline anchor which is sound from an engineering point of view, practical to construct, simple to install, and in which the load bearing component can be easily removed for reuse at a different location or for replacement subsequent to any damage. This is made possible by separating the roofline anchor into smaller components which are assembled at the installation location.

BRIEF DESCRIPTION OF THE FIGURES

The present invention will be more readily understood by reference to the following detailed description when read in conjunction with the attached drawings.

DETAILED DESCRIPTION

Figure 1:
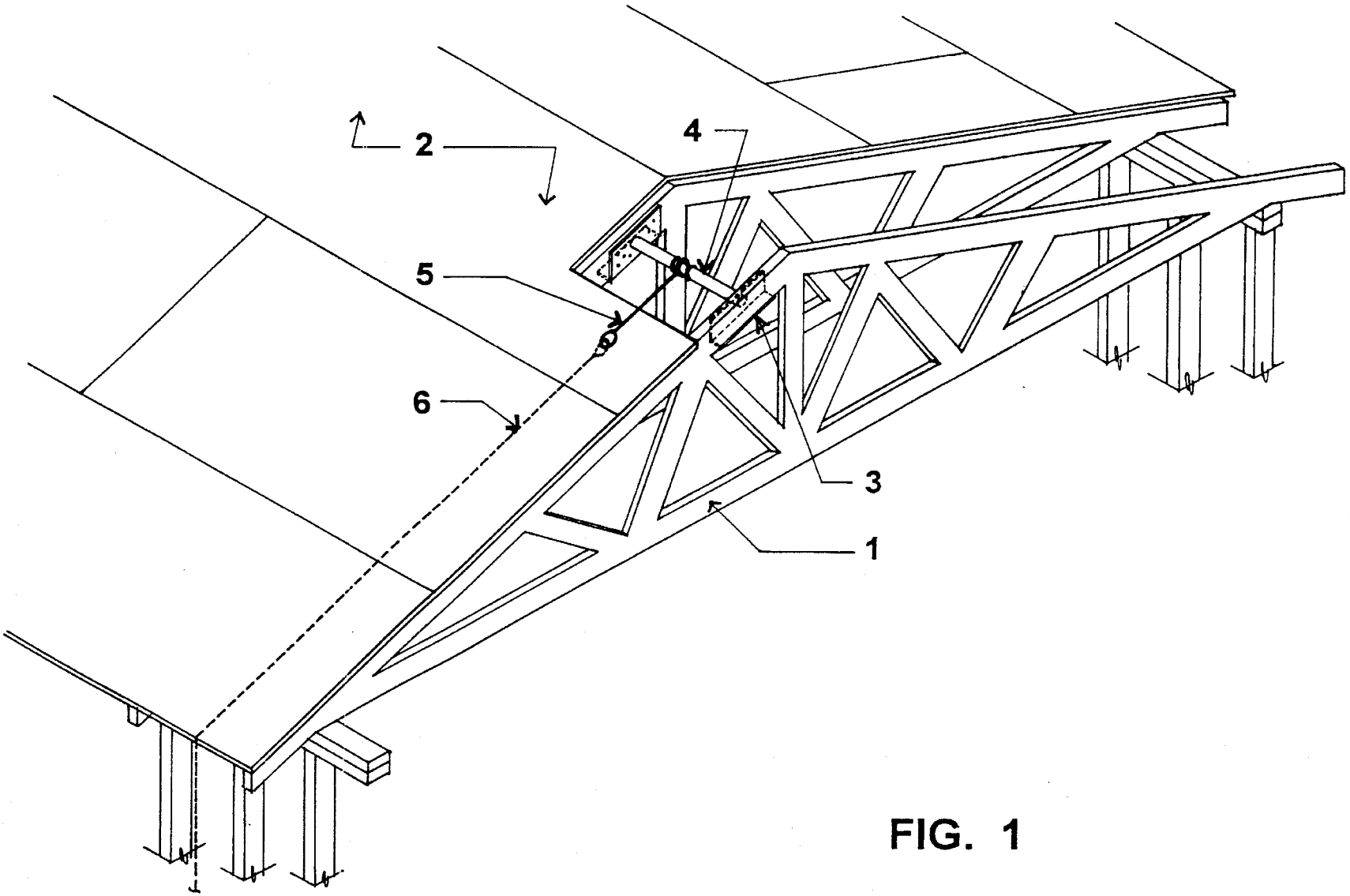
FIG. 1 is a perspective view of a typical roofing structure with the reusable roofline anchor of the present invention installed between two adjacent roof trusses.
Figure 2:
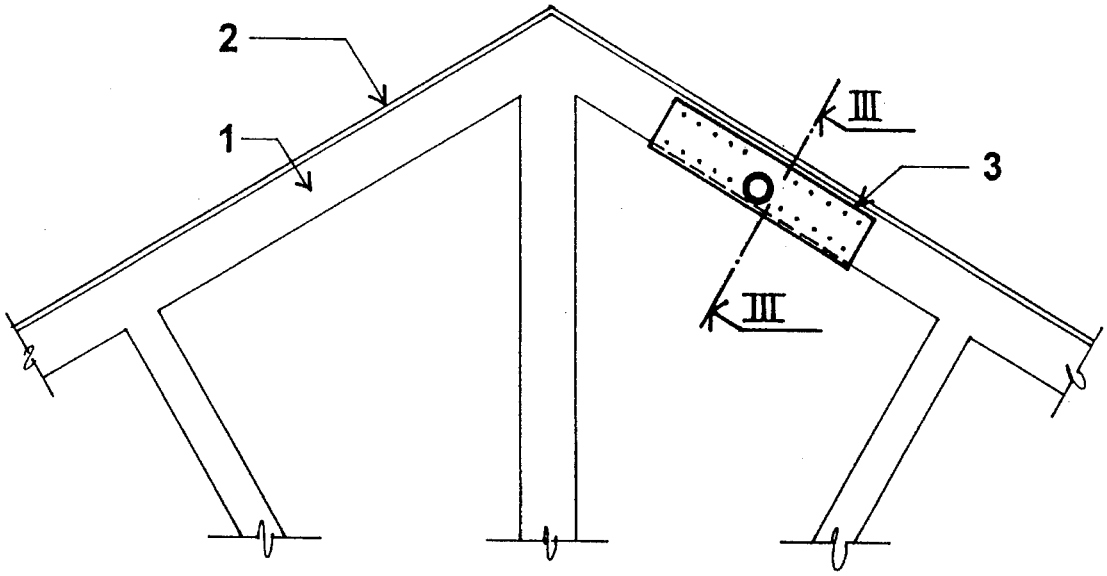
FIG. 2 depicts side elevation of the reusable roofline anchor as secured to the upper chord of a lumber roof truss.

In the FIG. 1 layout of a sloping roof, lumber roof trusses are indicated by 1, roof sheathing is indicated by 2, L-shaped attachment structure and horizontal load bearing member of circular cross-section of the reusable roofline anchor are indicated by 3 and 4 respectively, and a steel wire cable fastener which is indicated by 5 is used for securing a lifeline 6 to the roofline anchor. FIG. 2 depicts side elevation of the roofline anchor as secured to the top chord of a lumber roof truss.

Securing a roofline anchor to roof trusses is a difficult task because of the height at which the task is to be performed. The basic contribution of the present invention involves separation of the roofline anchor into smaller and convenient components which can be easily installed, besides providing for easy removal of the load bearing member for reuse at a different location or for replacement subsequent to damage.

Figure 3:
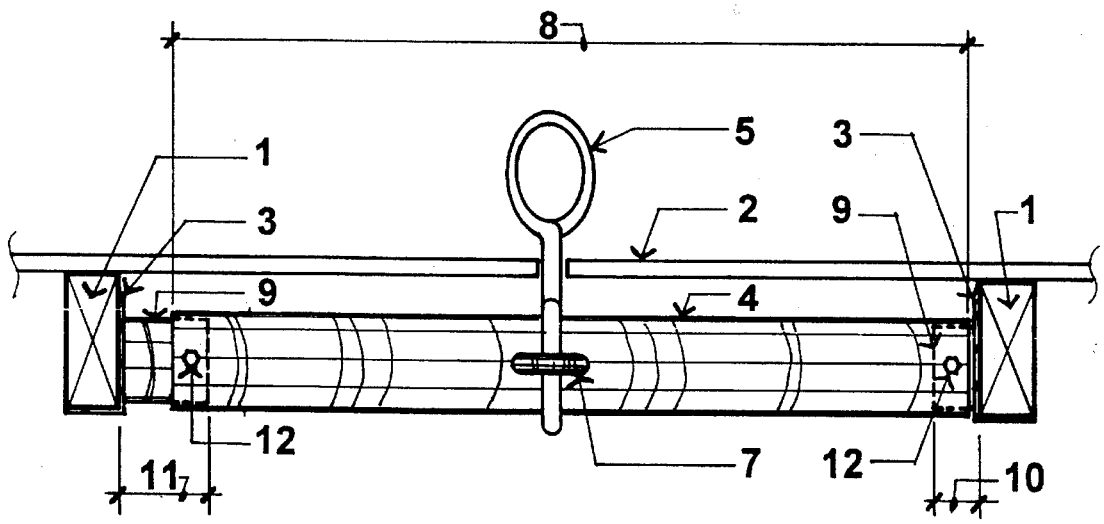
FIG. 3 is a view taken along lines III—III of FIG. 2, for describing details of the invention.

Referring to FIG. 3, the L-shaped attachment structures 3, one at each longitudinal end of load bearing member 4, are constructed from thin metal plates. Numeral 9 depicts metal struts of circular cross-section that are welded to the attachment structures, and are of a slightly smaller diameter than the load bearing member 4. The length of the load bearing member is indicated by 8. The struts 9, one at each end of the load bearing member, are kept of unequal lengths 10 and 11, and these unequal lengths are necessary during installation. Bolts 12 are use to restrict shifting of load bearing member. Numeral 5 indicates a steel wire cable that is used as a fastener for a lifeline. The effective diameter of the steel wire cable loop is kept slightly larger than the diameter of the load bearing member, so that the wire can just slide over the member. To restrict sideways slipping of the steel wire cable over the load bearing member, it is made to pass through a metal U-shaped bolt 7 attached to the load bearing member at its center.

Figure 4:
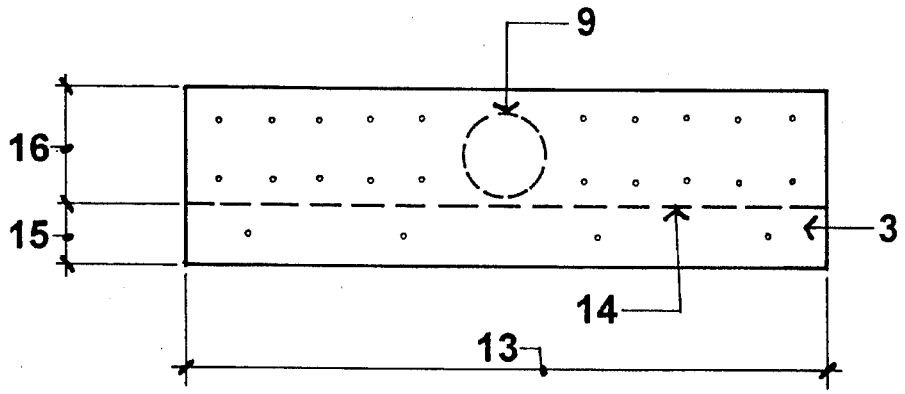
FIG. 4 is plan view of a attachment structure of the reusable roofline anchor before bending to its final shape.

FIG. 4 indicates details of the L-shaped attachment structure 3, in which 13, 15 and 16 are dimensions that are dependent on the size of the roof framing member to which the roofline anchor is to be secured, and 14 depicts the line along which the attachment structure is to be bent. In its installed position, 16 indicates the dimension of the vertical side of the L-shape.

The novel idea of using the present method of installation of a roofline anchor as described herein, is the significant ease involved during installation. As the first step of installation of the roofline anchor, both the attachment structures 3 with struts 9 welded to them, are secured to roof framing members from beneath by using nails, so that each attachment structure fits over and at least partially circumscribes its respective framing member. The load bearing member 4 with the steel wire cable fastener 5 and U-shaped bolt 7 attached to it, is oriented between the struts of the attachment structures from beneath, and is installed by sliding it over the longer strut first and then sliding it back over the shorter strut after proper alignment. Finally, bolts 12 are made to pass through aligned holes in the load bearing member and struts, and are tightened with nuts to prevent shifting of the load bearing member over the struts.

Figure 5:
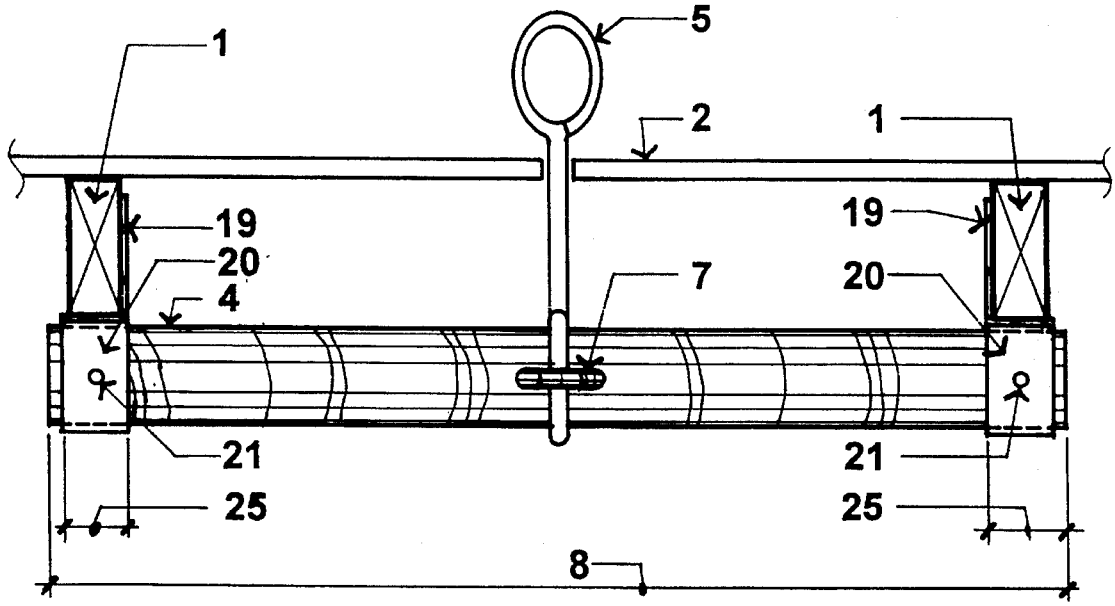
FIG. 5 illustrates a modified form of the invention.
Figure 6:
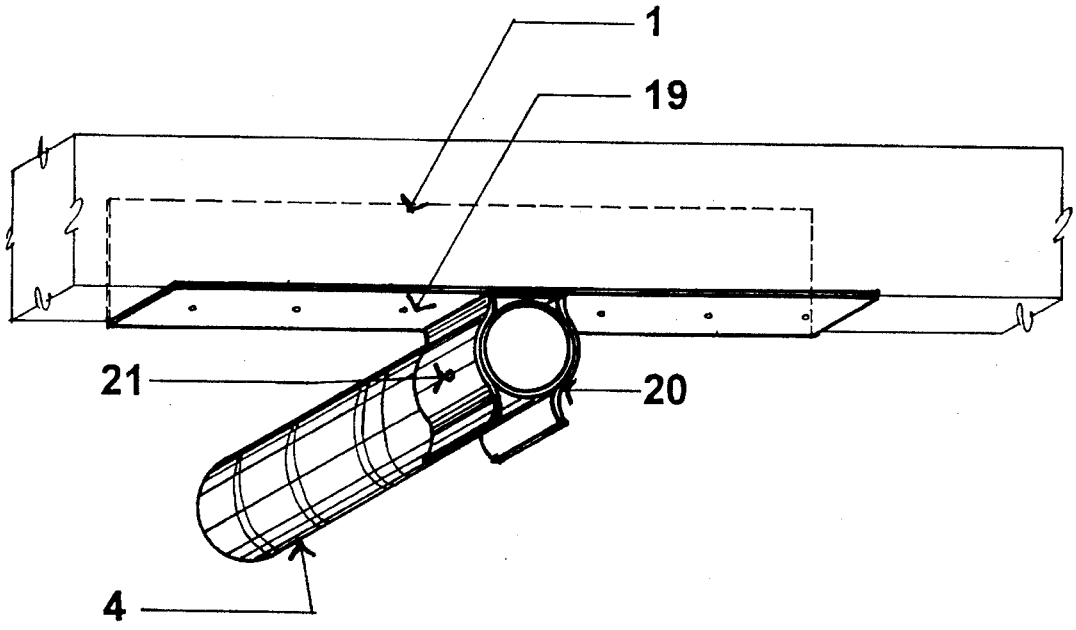
FIG. 6 depicts an isometric view of the modified form of FIG. 5 for describing its details.

FIG. 5 and FIG. 6 illustrate a modified form of the reusable roofline anchor, where attachment structures 19 have clips 20 welded to them. The load bearing member 4 is snapped in between the clips. Numeral 21 indicates pins that prevent shifting of the load bearing member relative to the clips.

Figure 7:
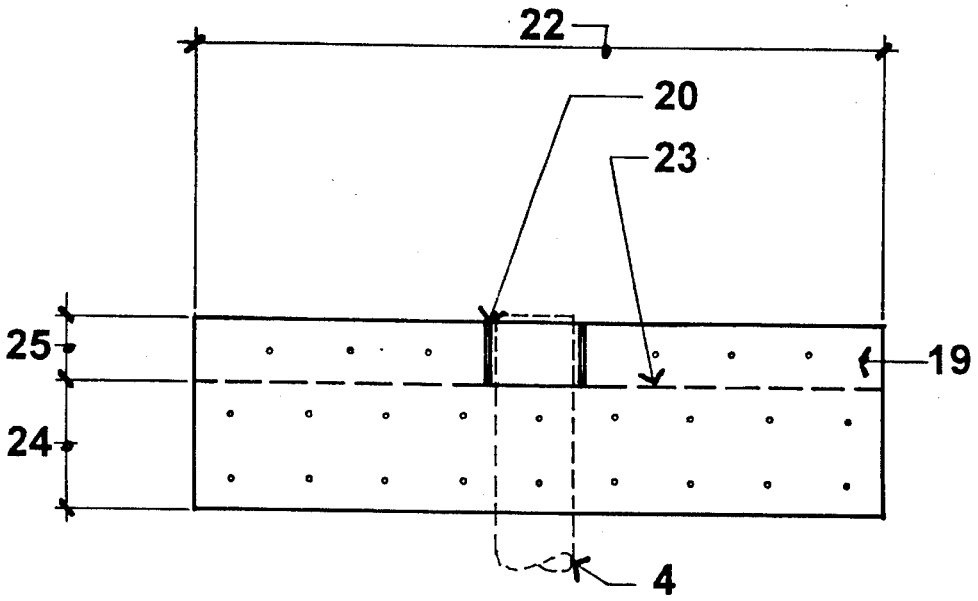
FIG. 7 is a plan view of a attachment structure of the modified form of FIG. 5 before bending to its final shape.
Figure 8:
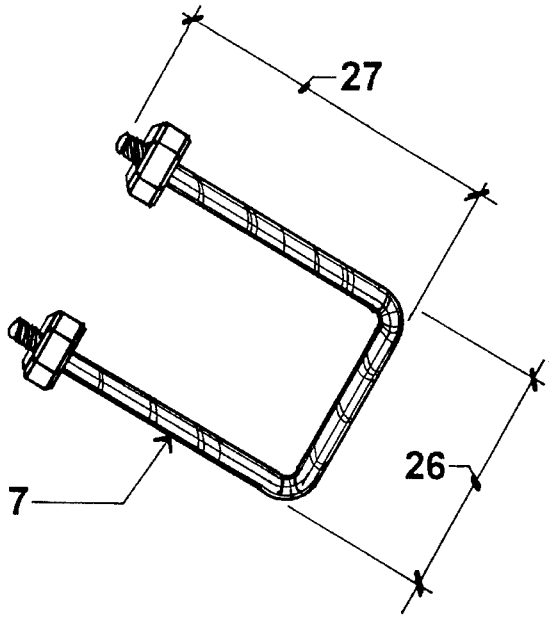
FIG. 8 depicts a U-shaped bolt used in the invention.

FIG. 7 depicts details of the L-shaped attachment structure 19, in which 22, 24 and 25 are dimensions that are dependent on the size of the roof framing member to which the roofline anchor is to be secured, and 23 indicates the line along which the attachment structure is to be bent. In its installed position, 24 indicates the dimension of the vertical side of the L-shape. Referring to FIG. 8, the U-shaped bolt 7 has dimensions 26 and 27 such that the steel wire cable fastener 5 is effectively restricted from slipping away from the center of the load bearing member.

At times it may be difficult to nail the bottom portion of the L-shaped attachment structures of FIG. 3 and FIG. 5. In such a situation, the invention recommends the use of U-shaped attachment structures and they have been shown in FIG. 9 & FIG. 11 respectively.

Figure 9:
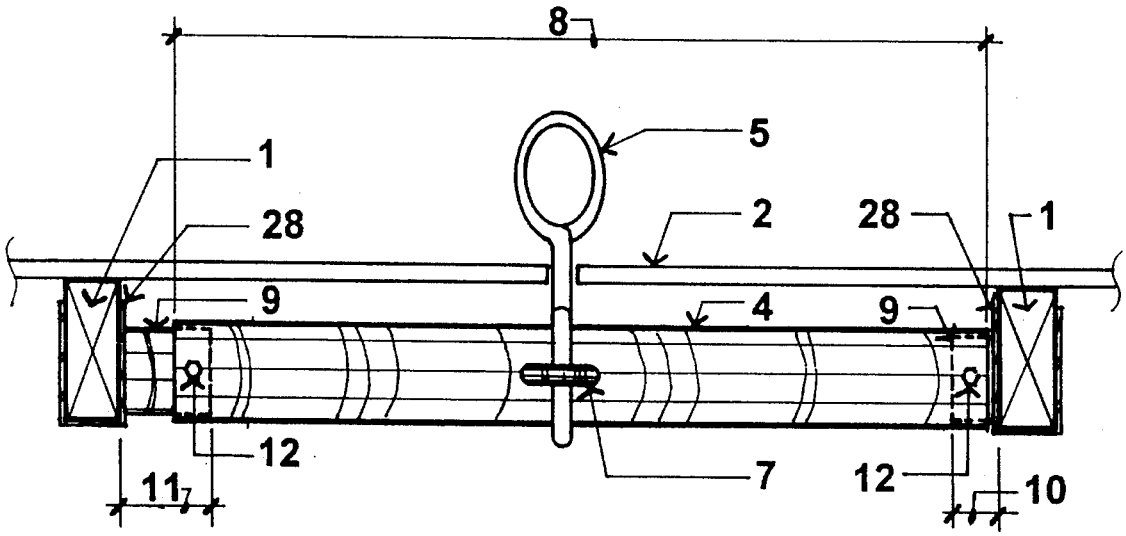
FIG. 9 depicts the reusable roofline anchor of FIG. 3 with a U-shaped attachment structure used as an alternative to the L-shaped attachment structure.
Figure 10:
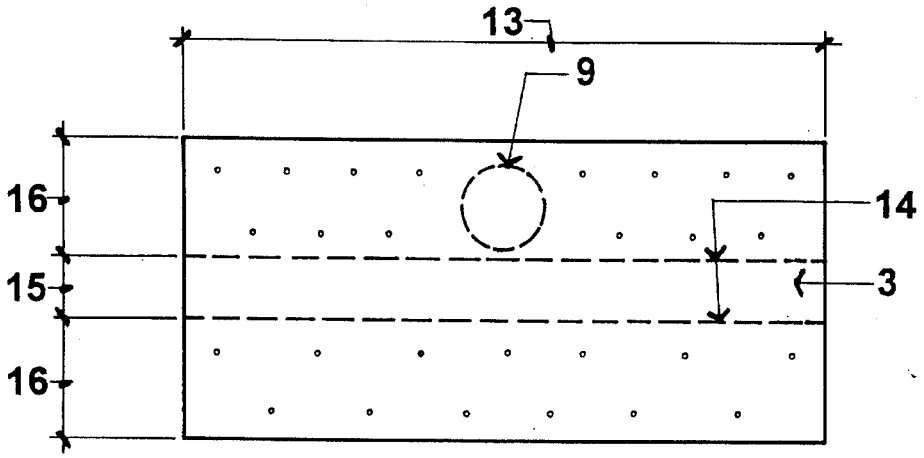
FIG. 10 is a plan view of the U-shaped attachment structure of FIG. 9 before bending to its final shape.

FIG. 10 depicts details of the U-shaped attachment structure 28 of FIG. 9, in which 13, 15 and 16 are dimensions that are dependent on the size of the roof framing member to which the roofline anchor is to be secured, and 14 indicates lines along which the attachment structure is to be bent. The required number of nails are put along the dimensions 16, with no nail along the dimension 15.

Figure 11:
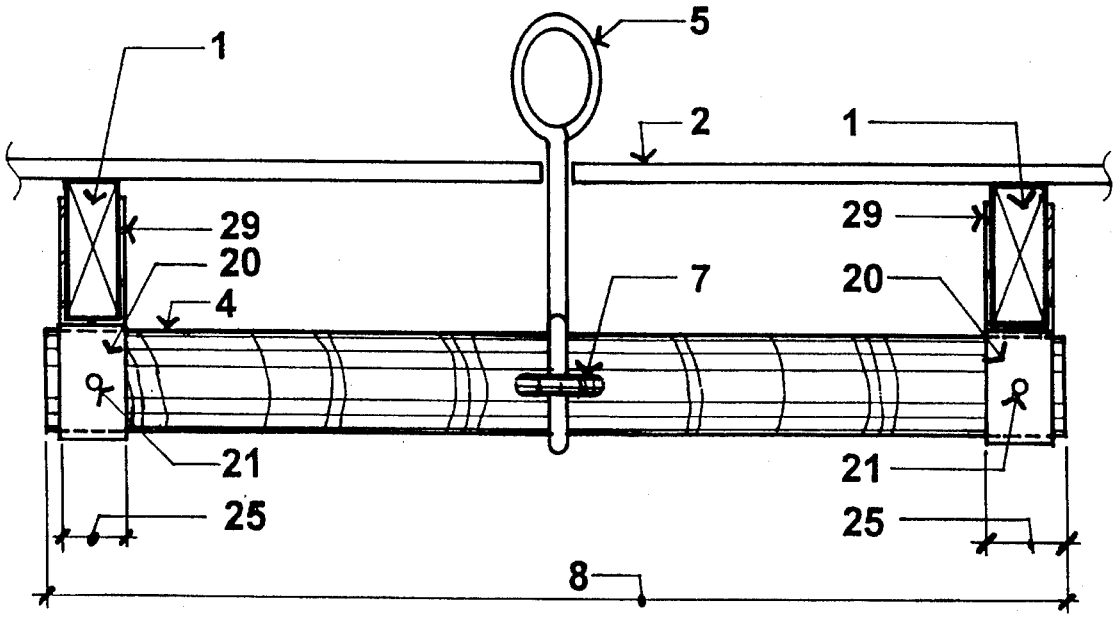
FIG. 11 depicts the modified reusable roofline anchor of FIG. 5 with a U-shaped attachment structure used as an alternative to the L-shaped attachment structure.
Figure 12:
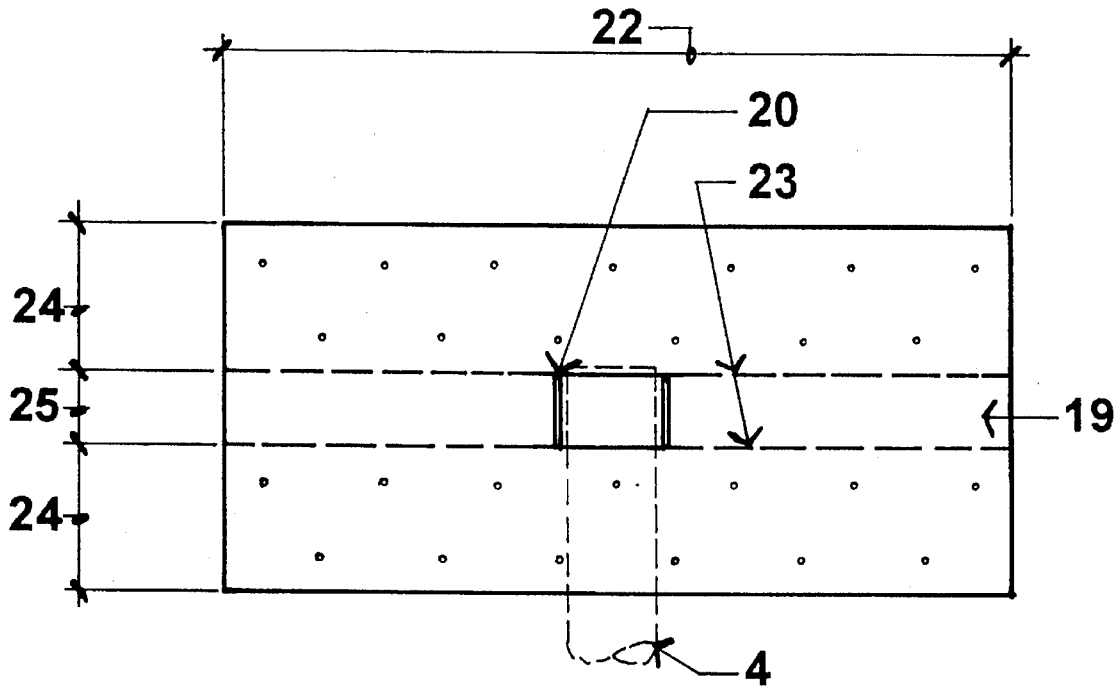
FIG. 12 is a plan view of the U-shaped attachment structure of FIG. 11 before bending to its final shape.

FIG. 12 depicts details of the attachment structure 29 of FIG. 11, in which 22, 24 and 25 are dimensions that are dependent on the size of the roof framing member to which the roofline anchor is to be secured, and 23 indicates lines along which the attachment structure is to be bent. The required number of nails are put along the dimensions 24, with no nail along the dimension 25.

While specific configurations have been set forth for the purpose of describing the novel features of the invention, it should be recognized that such specifics can be varied, by relying on the technology as taught, without departing from the principles of the invention. Therefore, in determining the scope of the present invention, reference shall be made to the appended claims.

What is claimed is:

1. A reusable roofline anchor, comprising of:

a load bearing member of circular cross-section, a steel wire cable connected to said load bearing member for anchoring a lifeline, a U-shaped bolt fixed to said load bearing member for restricting sideways movement of said steel wire cable, a pair of struts of unequal lengths welded to attachment structures of either L-shape or U-shape, one at each end of said load bearing member, for holding said load bearing member in the horizontal direction, and steel bolts for connecting said load bearing member to said struts to prevent sliding of said load bearing member over said struts;

the said load bearing member and said struts welded to said attachment structures being separate components and are assembled only during installation, thereby enabling removal of said load bearing member after said installation for reuse at another location or for replacement subsequent to any damage.

2. A method for attaching a reusable roofline anchor as claimed in claim 1, to framing members of adjacent roof trusses of residential buildings so as to provide lifeline support for roofing personnel, comprising the steps of:

securing each said attachment structure to a respective said framing member from beneath by using nails, each said attachment structure fitting over and at least partially circumscribing a said framing member, orienting said load bearing member to extend between said struts from beneath, sliding said load bearing member over longer said strut first and then back over shorter said strut after proper alignment, and tightening bolts passing through said load bearing member and said struts to prevent shifting of said load bearing member relative to said struts.

3. A reusable roofline anchor, comprising of:

a load bearing member of circular cross-section, a steel wire cable connected to said load bearing member for anchoring a lifeline, a U-shaped bolt fixed to said load bearing member for restricting sideways movement of said steel wire cable, a pair of clips welded to attachment structures of either L-shape or U-shape, one at each end of said load bearing member, for holding said load bearing member in the horizontal direction, and pins for passing through said clips and said load bearing member to prevent sliding of said load bearing member within said clips;

said load bearing member and said clips welded to said attachment structures being separate components and are assembled only during installation, thereby enabling removal of said load bearing member after said installation for reuse at another location or for replacement subsequent to any damage.

4. A method for attaching a reusable roofline anchor as claimed in claim 3, to framing members of adjacent roof trusses of residential buildings so as to provide lifeline support for roofing personnel, comprising the steps of:

securing each said attachment structure to a respective said framing member from beneath by using nails, each said attachment structure fitting over and at least partially circumscribing a said framing member, orienting said load bearing member to extend between said clips from beneath, sliding said load bearing member within one said clip first and then back within the other of said clips, and passing pins through said clips and said load bearing member to prevent shifting of said load bearing member relative to said clips.

* * * * *